US008777522B2

(12) United States Patent
Watson et al.

(10) Patent No.: US 8,777,522 B2
(45) **Date of Patent: *Jul. 15, 2014**

(54) MINE SEAL WITH MULTIPLE MORTARED WALLS

(75) Inventors: George A. Watson, Prosperity, PA (US); David A. Hussey, Glenwood Springs, CO (US); Stephen G. Sawyer, McMurray, PA (US)

(73) Assignee: Micon, Glassport, PA (US)

( * ) Notice: Subject to any disclaimer, the term of this patent is extended or adjusted under 35 U.S.C. 154(b) by 93 days.

This patent is subject to a terminal disclaimer.

(21) Appl. No.: 12/812,525

(22) PCT Filed: Jan. 14, 2009

(86) PCT No.: PCT/US2009/030950

§ 371 (c)(1),
(2), (4) Date: Oct. 4, 2010

(87) PCT Pub. No.: WO2009/097187

PCT Pub. Date: Aug. 6, 2009

(65) Prior Publication Data

US 2011/0013991 A1 Jan. 20, 2011

Related U.S. Application Data

(60) Provisional application No. 61/020,893, filed on Jan. 14, 2008.

(51) Int. Cl.
*E21F 17/103* (2006.01)

(52) U.S. Cl.
CPC ..... *E21F 17/103* (2013.01)
USPC ..... 405/288; 405/272; 299/11

(58) Field of Classification Search
USPC ..... 405/288, 289, 272, 273, 258.1; 299/11, 299/12
See application file for complete search history.

(56) References Cited

U.S. PATENT DOCUMENTS

| | | | | |
|---|---|---|---|---|
| 2,188,694 | A | 1/1940 | Tucker | |
| 3,240,736 | A * | 3/1966 | Beckwith | 524/2 |
| 3,856,741 | A * | 12/1974 | Lovell et al. | 524/783 |
| 4,237,182 | A * | 12/1980 | Fulmer et al. | 405/303 |
| 4,516,879 | A | 5/1985 | Berry et al. | |
| 4,607,066 | A * | 8/1986 | Barry et al. | 405/264 |
| 4,770,564 | A * | 9/1988 | Dison | 405/288 |

(Continued)

FOREIGN PATENT DOCUMENTS

WO 9810030 A1 3/1998

OTHER PUBLICATIONS

D.T. Kirkwood; K.K. Wu; Technical Considerations for the Design and Construction of Mine Seals to withstand Hydraulic Heads in Underground Mines; Jan. 1, 1995.*

*Primary Examiner* — Frederick L Lagman
(74) *Attorney, Agent, or Firm* — McNees Wallace & Nurick LLC

(57) ABSTRACT

An explosive-resistant mine seal (2) is provided, which includes a pair of block walls (14, 16). An adhesive (22) is provided between adjoining surfaces of the blocks (20) where the adhesive (22) has greater strength properties than the blocks (20) themselves. A core member (18, 18') is provided between the two walls (14, 16) and is bound thereto. The adhesive (22) may be coated over the walls (14, 16) to increase the strength of the mine seal (2).

17 Claims, 12 Drawing Sheets

(56) References Cited

U.S. PATENT DOCUMENTS

| | | | | |
|---|---|---|---|---|
| 4,940,360 | A | 7/1990 | Weholt | |
| 5,009,048 | A * | 4/1991 | Paul | 52/308 |
| 5,385,504 | A | 1/1995 | Hussey et al. | |
| 5,725,327 | A | 3/1998 | Hussey et al. | |
| 5,951,796 | A * | 9/1999 | Murray | 156/78 |
| 6,130,268 | A * | 10/2000 | Murray | 521/131 |
| 6,220,785 | B1 * | 4/2001 | Kennedy et al. | 405/288 |
| 6,422,790 | B1 | 7/2002 | Damron | |
| 6,425,820 | B1 | 7/2002 | Kennedy et al. | |
| 6,662,516 | B2 | 12/2003 | Vandehey et al. | |
| 6,955,502 | B2 | 10/2005 | Warren | |
| 2005/0095066 | A1 | 5/2005 | Warren | |
| 2005/0096411 | A1 | 5/2005 | Molla | |
| 2005/0115185 | A1 | 6/2005 | Telford et al. | |
| 2006/0002770 | A1 * | 1/2006 | Paton-Ash et al. | 405/288 |
| 2007/0066768 | A1 * | 3/2007 | Gauthier et al. | 525/477 |

* cited by examiner

MINE SEAL WITH MULTIPLE MORTARED WALLS

CROSS-REFERENCE TO RELATED APPLICATION

This application is a continuation-in-part of U.S. application Ser. No. 12/134,679, filed Jun. 6, 2008, which claims the benefit of U.S. Provisional Application No. 60/933,555, filed Jun. 7, 2007, and this application also claims the benefit of U.S. Provisional Application No. 61/020,893, filed Jan. 14, 2008, the entire contents of all of said applications is hereby incorporated by reference.

BACKGROUND OF THE INVENTION

1. Field of the Invention

The present invention relates to permanent isolation seals for mining applications and, more particularly, to a permanent seal in an underground entry to isolate the atmosphere on one side of the seal from the atmosphere on the other side.

2. Description of Related Art

In underground mining, there is typically a need to isolate the atmosphere in a specific portion of the mine. A seal is provided to isolate areas of the mine for purposes such as to limit the area of the mine workings that need to be ventilated, to control the dissemination of any toxic or explosive gases in the mine, or to allow the atmosphere in an isolated part of the mine to change its composition to a less hazardous state. Seals are constructed across individual mining entries or tunnels to provide such isolation.

Seals have been traditionally constructed as walls of stacked concrete blocks that may be coated or joined together with a cementitious material, which is considerably weaker than the concrete blocks themselves. Further, the cementitious material typically shrinks over time creating leaks in the seal and possibly allowing dangerous gases to bypass the seal. Blocks are fitted across a mine opening in a staggered or overlapping relationship. Such seals, however, have not been found to withstand mine explosion overpressures of over 20 psi. More recently, a mine seal has been employed that incorporates concrete block walls sandwiching an inner core of a polymeric material containing aggregate. This composite structure of a core provided between two concrete block walls (described in U.S. Pat. No. 5,385,504, incorporated herein by reference), is constructed by dry-stacking concrete blocks to form walls between the roof, floor, and ribs of a mine entry. A rear wall is first constructed and wedged into place. Next, a front wall is constructed to a height of 2-3 feet and construction continues by pyramiding the blocks until one or two blocks are in contact with the roof. The core material is installed between the fully constructed rear wall and the partially constructed front wall by providing a layer of aggregate material (gravel or the like) between the walls and coating the aggregate material with foamable polyurethane. As the polyurethane foams and cures, the polyurethane increases in height (with the aggregate mixed therein) and solidifies, adhering to the rear and front walls. Construction of the front wall continues and additional layers of the core material (polyurethane and aggregate) are provided between the rear wall and the growing front wall until the core material and the front wall reach the roof of the mine entry. The outside surface of the front wall is covered with a coating of a fire-resistant sealant satisfying the guidelines of the Mine Safety and Health Administration (MSHA). While this composite seal withstands mine explosion overpressures of at least 20 psi, a need has been identified to increase the pressure rating of mine seals.

SUMMARY OF THE INVENTION

This need is met by the mine seal of the present invention that includes a pair of walls, each wall including a plurality of blocks and a core provided between the walls and adhering to the walls. An adhesive is provided between adjoining surfaces of the blocks of the walls. The sealant has greater strength properties than the blocks. The main seal may further include at least one internal wall to provide additional strengthening of the seal. The present invention also includes a method of strengthening a wall that includes a plurality of blocks by providing a plurality of individual blocks, coating a surface of each block with an adhesive, and stacking the blocks to form a wall with the adhesive being positioned between adjoining surfaces of the blocks, wherein the adhesive has greater strength properties than the individual blocks.

The present invention also includes an explosion-resistant mine seal comprising a front wall and a back wall, each wall comprising a plurality of blocks, an adhesive provided between adjoining surfaces of the block, the adhesive having greater strength properties than the blocks, and a core member provided between the walls and adhering to the walls. Also included in the present invention is an explosive-resistant mine seal comprising a front wall structure and a rear wall structure, each wall structure comprising a plurality of blocks and an adhesive provided between adjoining surfaces of the blocks, wherein the adhesive has greater strength properties than the blocks, and a core member provided between the wall structures and adhering to the wall structures, wherein at least one of the wall structures comprises a multiple wythe wall.

DESCRIPTION OF THE INVENTION

Figure 1:
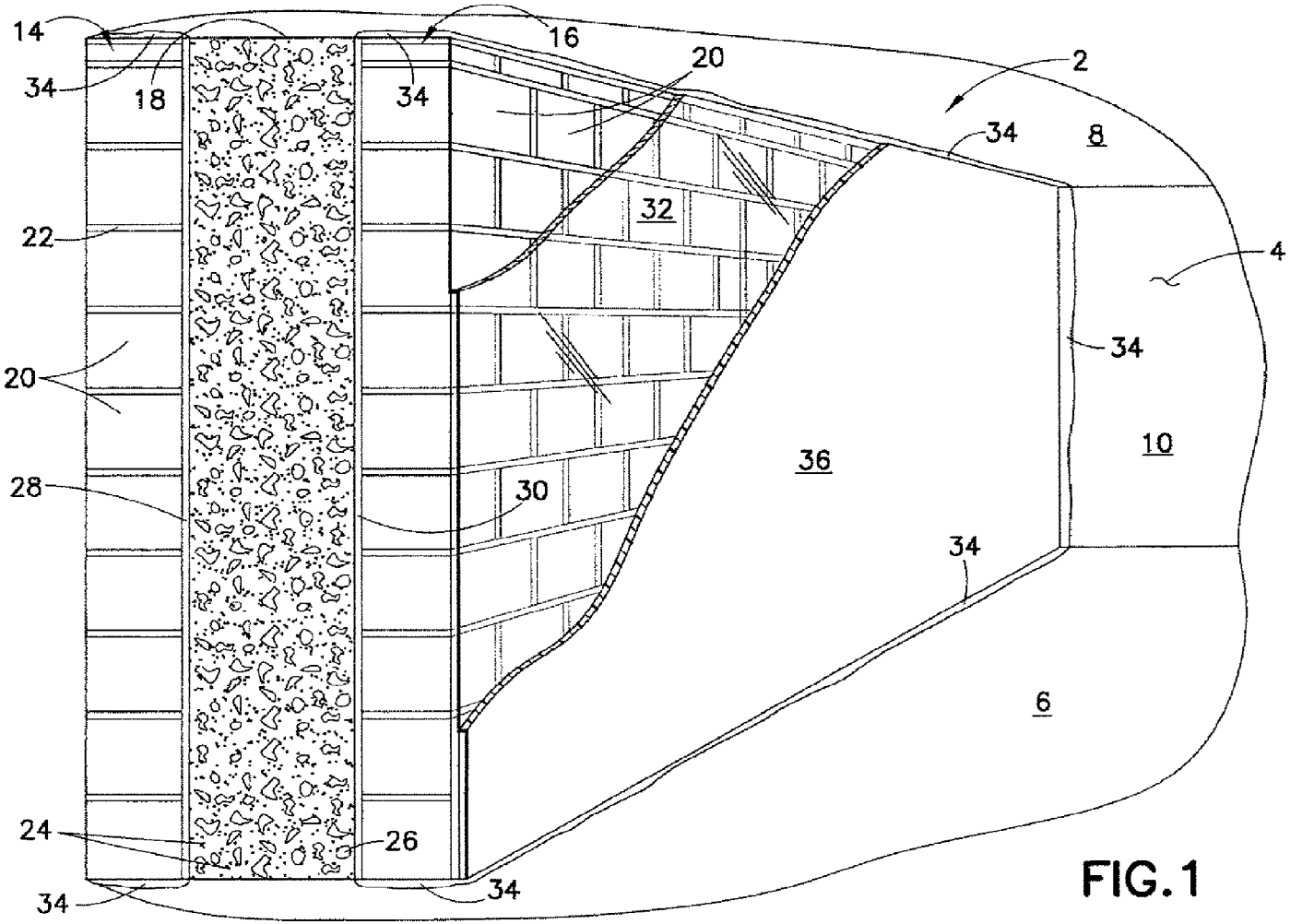
FIG. 1 is a perspective view of a constructed seal of the present invention, shown partially in section.
Figure 2:
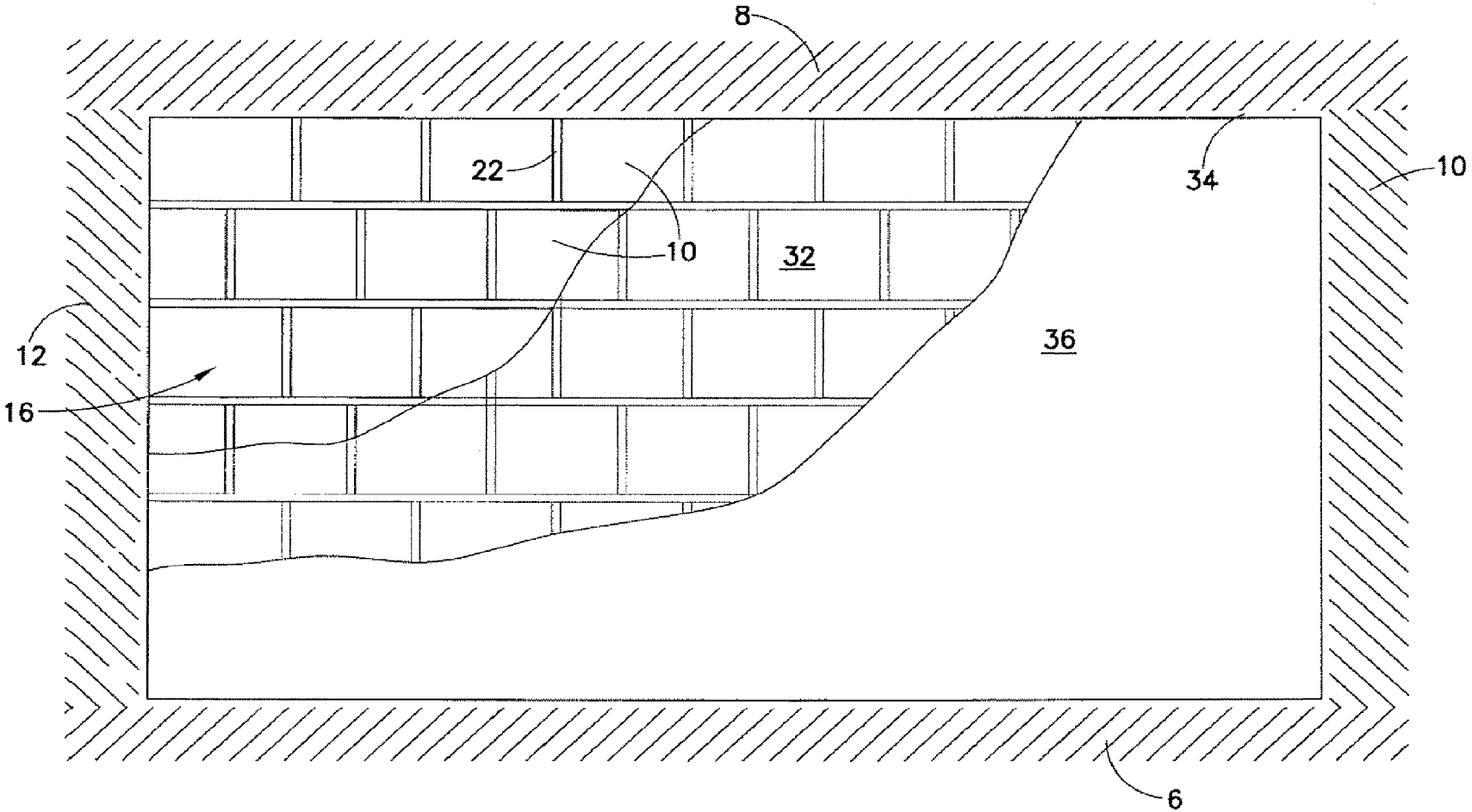
FIG. 2 is an elevational view of the front wall of the mine seal of the present invention installed in a mine entry.

Referring to FIGS. 1 and 2, the present invention is directed to an explosion-resistant mine seal 2 spanning a mine entry 4 defined by a floor 6, roof 8 and pillars 10, 12. The seal 2 includes a rear composite block wall 14 and a front composite block wall 16, both spanning the mine entry 4 with a core member 18 sandwiched therebetween. The walls 14, 16 are composed of a plurality of blocks 20, such as masonry blocks, adhered together via an adhesive 22. By masonry blocks, it is meant blocks of common construction such as blocks of brick, stone or concrete, but the material of the blocks is not limited thereto. The adhesive 22 is provided between the adjoining surfaces of the blocks 20 in a generally fluidized or flowable form, which cures shortly after its application to the blocks 20, e.g., within 30 seconds. In this manner, the adhesive 22 acts as a mortar between the blocks 20 of the walls 14, 16. One non-limiting example of a suitable composition for the adhesive 22 is a polyurethane provided as RokLok® 70 available from Micon, Inc. of Glassport, Pa. By using a rapid curing adhesive, the composite block walls 14, 16 may be quickly constructed. For example, by the time one course of blocks 20 is laid with adhesive 22 therebetween, the adhesive 22 has cured so that the next course of blocks 20 is laid onto the just-constructed composite course of blocks 20 and adhesive 22. Other polymeric adhesives may be used to produce the composite block walls 14, 16 according to the present invention. The composite block walls 14, 16 used in the seal 2 of the present invention have greater strength properties than the blocks 20 themselves or a conventional seal wall constructed by dry stacking the blocks 20. Accordingly, the strongest portion of the composite block walls 14, 16 is the adhesive 22 between the blocks 20. Properties that are important to the strength of the composite walls 14, 16 include the compressive strength, flexural strength, shear strength, and tensile strength. To construct composite block walls 14, 16 for use in the seal 2 of the present invention, these strength properties for the adhesive 22 should be greater than the corresponding properties in the blocks 20. In this manner, the composite walls 14, 16 exhibit strength properties in excess of the strength properties of the blocks 20 themselves.

The strength of the seal 2 may be enhanced by including an adhesive layer on one or more surfaces of the composite block walls 14, 16, such as surface layers 28, 30 on respective walls 14, 16 facing the core member 18 and/or front surface layer 32 on front wall 16. It should be understood that the thickness of the layers 28, 30, 32 and the thickness of the adhesive 22 between the blocks 20 are exaggerated in the drawings for illustration and may be selected based on the design parameters for the strength requirements of a particular installation of the seal 2. The seal 2 may further include, in addition to the rear composite block wall 14, the front composite block wall 16, and the core member 18, one or more interior walls (such as a solid concrete block wall as described herein with respect to walls 14, 16) to provide additional strengthening of the seal. Additional core members 18 may be provided between each interior wall and between each interior wall and the walls 14, 16.

Additional adhesive may be provided between walls 14, 16 and the surfaces of the mine entry 4 as at 34. This additional adhesive 34 can fill in gaps between the walls 14, 16 and floor 6, roof 8, and pillars 10, 12, particularly in rough mine entries. Additional adhesive 34 also serves to bind the seal 2 to the mine entry surfaces and increase the integrity of the seal 2 as the adhesive 34 seeps into cracks in the entry surfaces and cures therein. The exposed surface of front wall 16 or front surface layer 32 may be coated with a conventional MSHA-approved fire-resistant sealant layer 36.

The core member 18 provided between any two walls may be produced from a binding material 24, such as a foamable polyurethane (e.g., RokLok® 10 available from Micon, Inc.). A foamable polyurethane expands upon curing to produce a network of closed cell foam that fills in any void spaces between the two composite block walls 14, 16. Other binding materials may be used, such as plastics, polymeric foams, and synthetic foams. The core member 18 binds to both composite block walls 14, 16, thereby creating an integral seal. The core member 18 may include aggregate material 26 (such as gravel, limestone, talc, glass, or other inert filler particulates). The aggregate material 26 is used in combination with the binding material 24 to increase the strength of the core member 18 at minimal expense. The proportion of aggregate material 26 to binding material 24 may be adjusted to ensure sufficient binding of the core member 18 to the composite block walls 14, 16.

Figure 3:
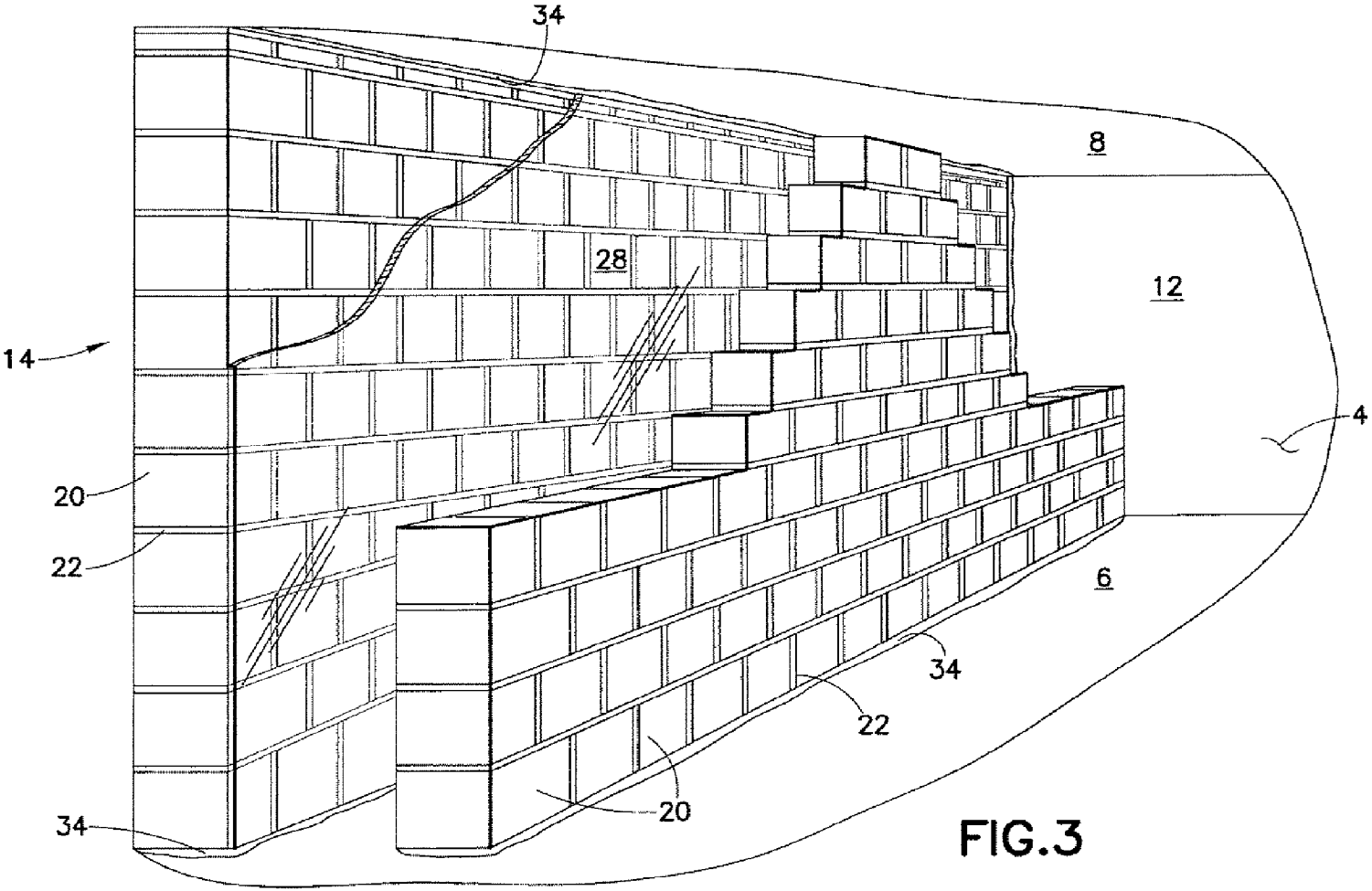
FIG. 3 is a perspective view of a first stage of constructing the mine seal of the present invention.
Figure 4:
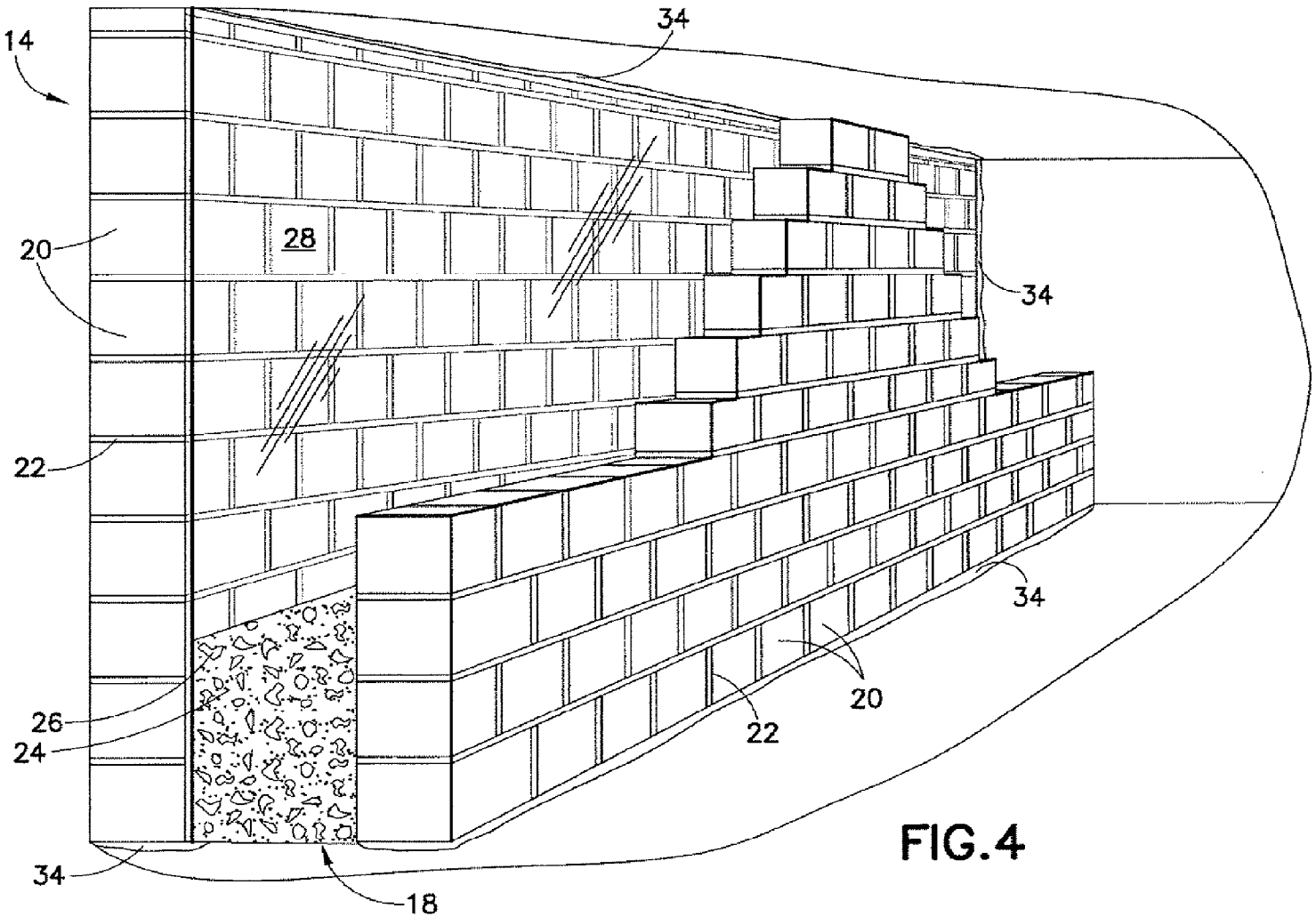
FIG. 4 is a perspective view of a second stage of constructing a mine seal of the present invention.

FIGS. 3-4 show a method of constructing the mine seal of the present invention. The seal 2 is produced by first constructing the rear wall 14 from a plurality of blocks 20, such as concrete blocks arranged in an overlapping manner. As the backside of the rear wall 14 (not shown) is constructed, a coating of a fire-retardant sealant may be applied thereto. A first course of concrete blocks are laid across the mine floor between the mine pillars 10, 12. The end surfaces of adjoining blocks 20 are coated with the adhesive 22. The adhesive 22 may be provided as a curable resin with a curing agent that is maintained separate until application to the blocks 20 via a delivery tube with a static mixer or the like. The adhesive 22 is generally flowable upon application, but quickly solidifies upon curing. The adhesive 22 used in the walls 14, 16 may be the same or different from the adhesives 22 used in surface layers 28, 30, 32 and the additional adhesive 34. Upon curing (hardening) of the adhesive 22, the blocks 20 bind together. Subsequent courses of blocks 20 are positioned by applying a layer of the adhesive 22 to the exposed surfaces between the courses of blocks 20 and between the adjoining surfaces of blocks 20 within each subsequent course. Construction continues until the rear composite block wall 14 reaches the roof 8 of the mine and spans the entire entry 4. An initial layer of additional adhesive 34 may be applied to the mine floor 6 with the first course of blocks 20 being positioned in this initial layer of adhesive 34. Additional adhesive 34 may be injected at the roof 8 and pillars 10, 12 in order to achieve a complete fit of the rear composite block wall 14 between all the mine entry 4 surfaces. A coating of adhesive (not shown) may be applied to the rear wall 14 to increase the strength of the rear wall 14. After the rear wall 14 is constructed, the first several courses of the front wall 16 are constructed in a similar manner as the rear wall 14, as well as the center portion of the front wall 16 which contacts the mine roof 8. Additional adhesive 34 may be inserted into gaps between the rear wall 14 and floor 6, roof 8, and pillars 10, 12.

The core member 18 is installed stepwise along with construction of the front wall 16. A layer of the aggregate material 26 is provided behind the partially constructed front wall 16 and the foamable polyurethane (or other binding material 24) is applied to the aggregate layer. As the polyurethane cures and foams, the aggregate material 26 moves therewith to fill the gap between the back and front walls 14, 16. Subsequent courses of the concrete blocks 20 are constructed and additional aggregate material 26 and binding material 24 are placed on top of the precedingly produced foamed polyurethane/aggregate layer between the two walls 14, 16 until the front wall 16 and core member 18 are completely constructed.

Alternatively, the core member 18 may be constructed stepwise by applying layers of foamed polyurethane into the gap between the rear wall 14 and building the front wall 16 without the aggregate material 26. The adhesive 22 may be applied to the backside of the front wall 16 as the first wall is constructed, creating surface layer 30, and/or may be applied to the exposed surface of the front wall 16 as front surface layer 32 for providing additional strength to the seal. The adhesive layers 28, 30, and 32, as well as additional adhesive 34 are used depending on the strength requirements for the seal 2. In certain embodiments, at least a portion of the rear wall 14 or front wall 16 may be secured to the floor 6, roof 8, or pillars 10, 12 with one or more angle irons to secure the wall within the mine entry 4. In one embodiment, a 6"×6"×½" angle iron (not shown) is attached to the floor 6 and the pillars 10, 12 with case hardened bolts having a length of at least 18 inches and top nuts that can be tightened against the angle. The gaps between the angle iron and the walls 14, 16 or between the angle irons and the floor 6 or the pillars 10, 12 may be filled with the adhesive 22. In other embodiments, the mine entry 4 surfaces, including the floor 6, roof 8, and pillars 10, 12 may be excavated to create a trench or groove for securing at least one course of blocks 20 within the mine entry. Finally, a fire-resistant sealant 36 is applied to the exposed surface of the front wall 16 or front surface layer 32.

Figure 5:
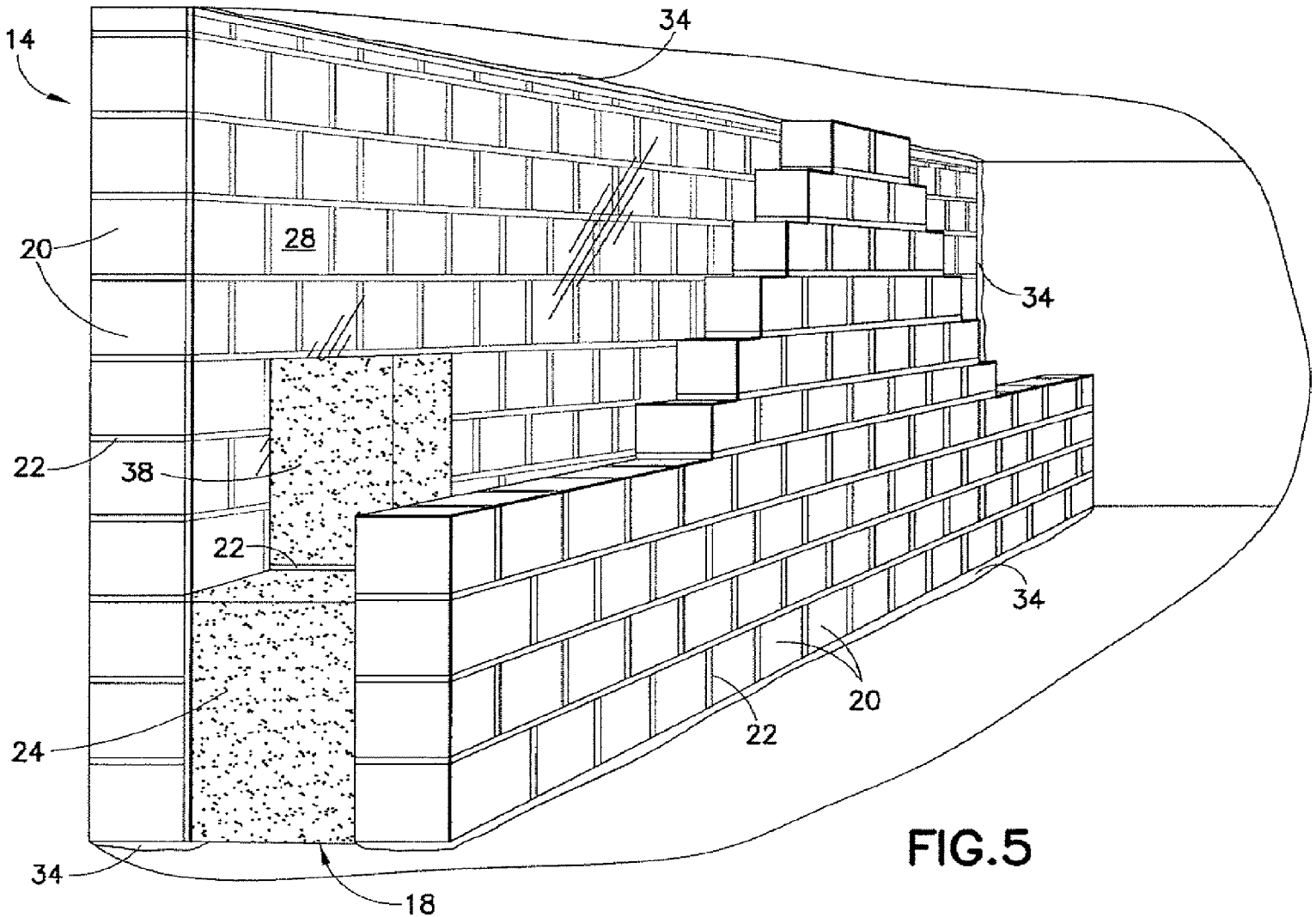
FIG. 5 is a perspective view of a second stage of constructing a mine seal according to one embodiment of the present invention.

In one embodiment of the present invention, shown in FIG. 5, a core member 18' between the two walls is provided as a plurality of blocks 38 produced from the binding material 24, such as a foamable polyurethane (e.g., RokLok® 10 available from Micon, Inc.). Other binding materials may be used, such as plastics, polymeric foams, and synthetic foams. The plurality of blocks 38 may be precast above the ground and transported to the mine entry 4. Production of the blocks 38 above-ground also reduces exposure of personnel to chemicals and/or fumes that may occur when core member 18 is produced in situ in the closed environment of a mine entry. The blocks 38 may be checked for quality standards (e.g., as meeting a desired density for proper function in a seal) above-ground in a controlled environment. The plurality of blocks 38 produced from the binding material 24 may also be sized and shaped to allow the blocks 38 to be efficiently carried and lifted by an installation worker. For example, blocks produced from a polyurethane having a density of about 12 pounds per cubic foot may be sized about 4 cubic feet and be handleable by an individual.

The plurality of blocks 38 may be installed stepwise along with construction of the front wall 16 as shown in FIG. 5 and described hereinabove with respect to FIGS. 3-4. The plurality of blocks 38 may also be installed prior to installation of the front wall 16. In either case, installation of the plurality of blocks 38 to form the core member 18' may be accomplished in a similar manner as described hereinabove with respect to installation of the concrete blocks 20. An initial layer of adhesive 34 may be applied to the mine floor 6 with the first course of blocks 38 being positioned in the initial adhesive layer 22. Subsequent courses of blocks 38 are positioned by applying a layer of the adhesive 22 to the exposed surfaces between the courses of blocks 38 and between the adjoining surfaces of blocks 38 within each subsequent course. Construction continues until the core member 18' reaches the roof 8 of the mine and spans the entire entry 4. Additional adhesive 34 may be injected at the roof 8 and pillars 10, 12 in order to achieve a complete fit of the core member 18' between all the mine entry 4 surfaces. In this manner, a core produced from blocks 38 adhered together creates a monolithic core structure, wherein the core produced from blocks 38 exhibits strength properties in excess of the strength of the individual blocks 38.

A monolithic core structure of the blocks 38 adhered together with adhesive 22 may be produced in a few hours (such as about 2 hours) as compared to production of conventional block seals produced from cementitious materials that may require up to several days to cure and be useable. Further, the blocks may be cut and shaped at the installation site to fit the mine entry 4. Foamable polyurethane creates heat as it cures and foams through an exothermic reaction. The heat from this reaction may cause certain safety concerns, such as an increased risk of a fire in an underground mine environment. Thus, forming the core member 18' from the plurality of blocks 38 above-ground minimizes the amount of heat created in an underground mine.

Figure 6:
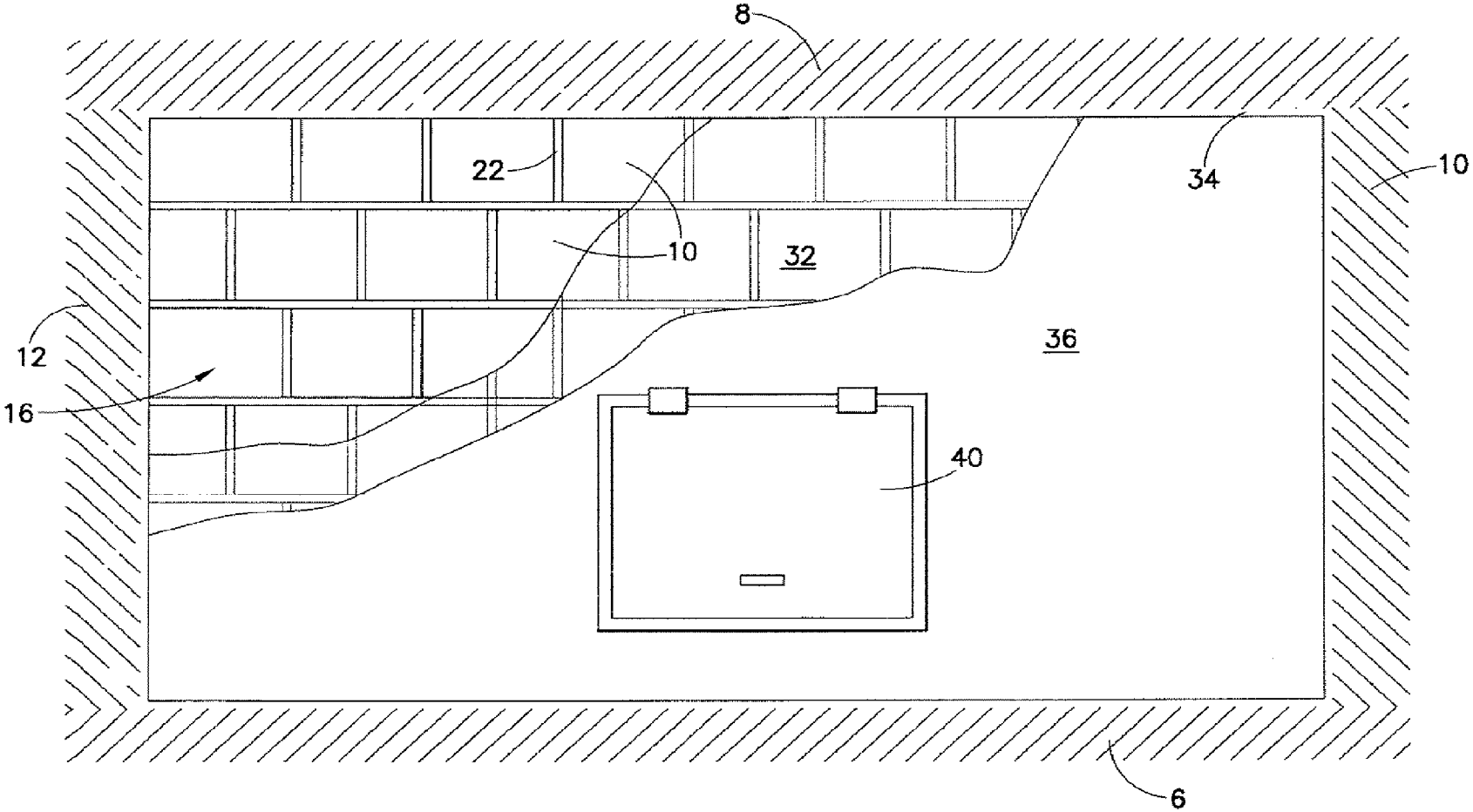
FIG. 6 is an elevational view of the front wall of a mine seal installed in a mine entry according to a further embodiment of the present invention.

In a further embodiment of the present invention, shown in FIG. 6, the mine seal 2 includes a closeable opening extending through the rear block wall 14, the front block wall 16, and the core member 18 or 18'. A pair of doors 40 may be positioned on the front block wall 16 and the rear block wall 14 to selectively allow access through the closable opening. The concrete blocks 20 may be used to form an arch or opening (not shown) that extends through the thickness of the mine seal 2. The door 40 may be a swinging-type man door, a guillotine-type man door, or any other suitable type of door arrangement. The mine seal 2 may function as a ventilation seal when the seal 2 includes the closeable opening and doors 40 and may subsequently be converted to an explosion seal by removing the doors 40 and closing the opening using the plurality of blocks 20 and a core member 18 or 18' as described hereinabove.

Figure 7:
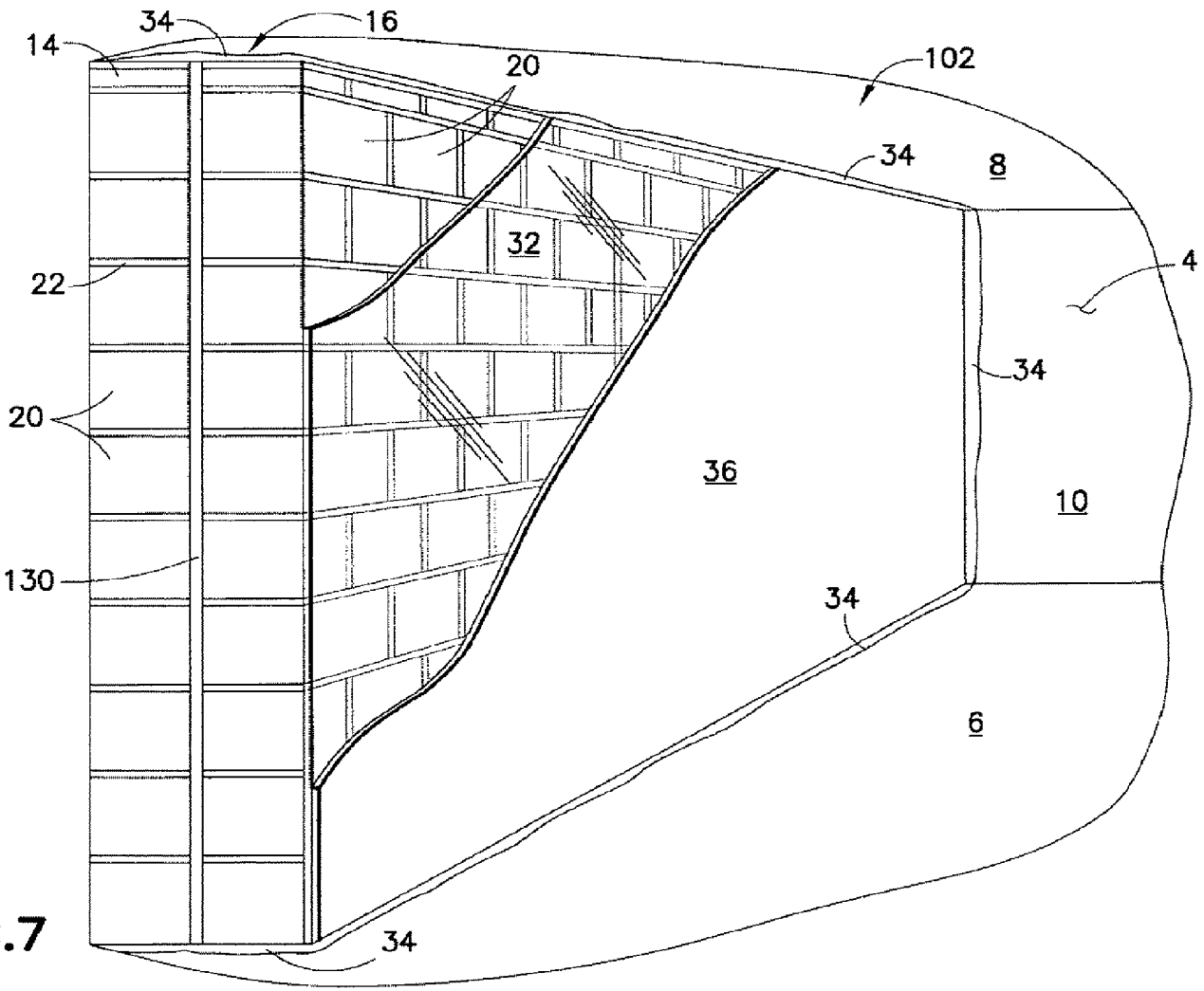
FIG. 7 is a perspective view of a seal according to another embodiment of the present invention, shown partially in section.

FIG. 7 shows another embodiment of the present invention directed to an explosion-resistant mine seal 102 spanning a mine entry 4 defined by a floor 6, roof 8 and pillars 10, 12 (not shown). The seal 102 is similar to seal 2 but lacks a core member 18 or 18'. Seal 102 includes a rear composite block wall 14 and a front composite block wall 16 composed of a plurality of blocks 20 adhered together via an adhesive 22.

An adhesive layer 130 is provided between the walls 14, 16 to provide additional strength to the seal 102 as well as to fill any voids between the walls 14, 16, thereby creating an integral seal. The front wall 16 may also include a front surface layer 32 to provide additional strength to seal 102. It should be understood that the thickness of the layers 32, 130 and the thickness of the adhesive 22 between the blocks 20 are exaggerated in the drawings for illustration and may be selected based on the design parameters for the strength requirements of a particular installation of the seal 102. The mine seal 102, as detailed above, is also not limited to a rear wall 14 and a front wall 16 and may include a plurality of walls with each wall having an adhesive layer 130 provided between each wall to provide additional strength to the seal 102 as well as to fill any voids between the walls 14, 16. The exposed surface of front wall 16 or front surface layer 32 may or may not be coated with a fire-resistant sealant layer 36.

Figure 8:
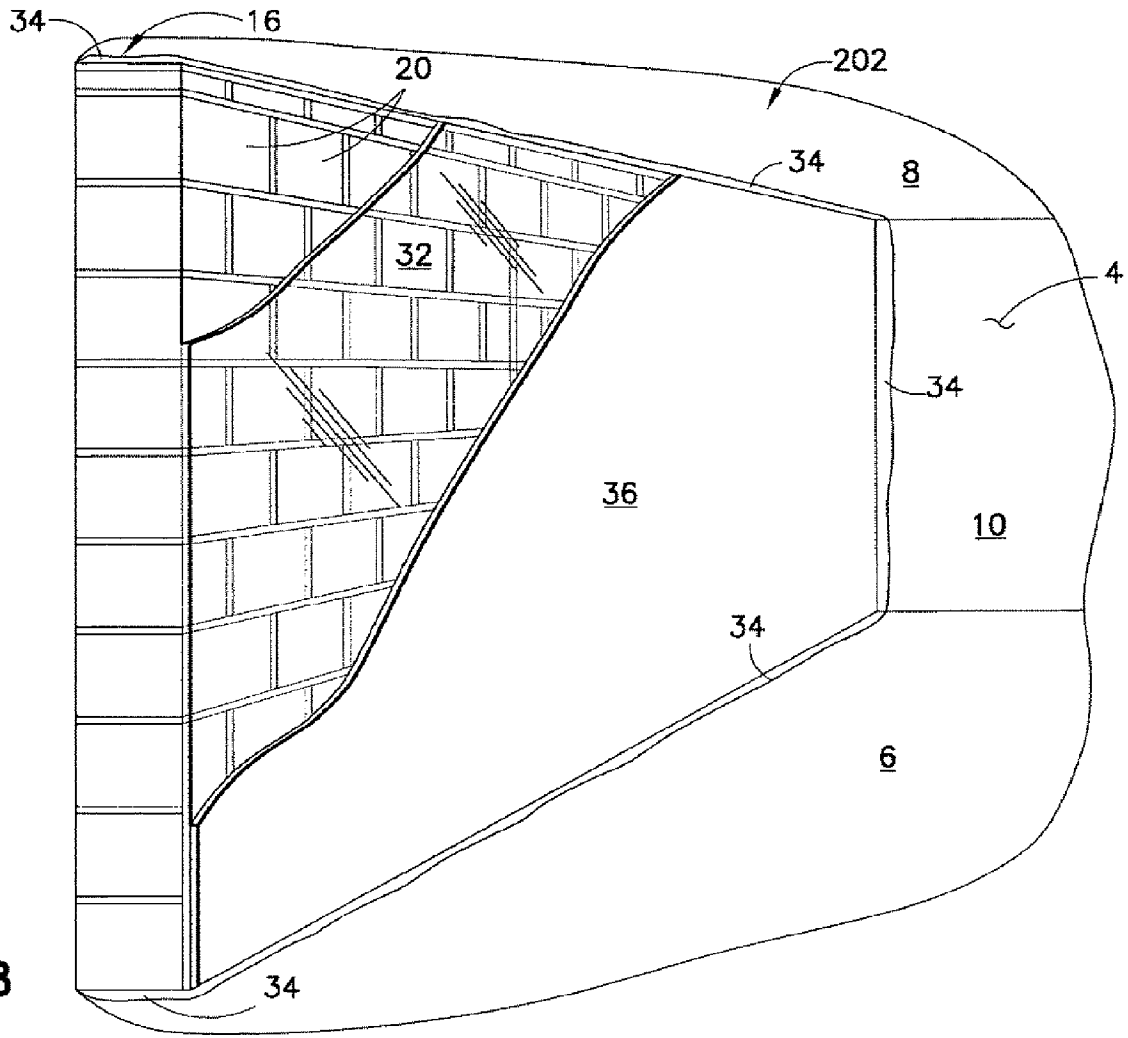
FIG. 8 is a perspective view of a seal according to another embodiment of the present invention, shown partially in section.

In another embodiment shown in FIG. 8, a mine seal 202 includes only one composite wall 16 having a plurality of blocks 20 adhered together via the adhesive 22. The single wall may include the adhesive layer 32 on a front side of the wall 16. The single wall may or may not include the additional adhesive 34 as well as the fire-resistant sealant layer 36.

The mine seal according to the embodiments described above and shown in FIGS. 1-8 use single wythe walls where a single row of blocks 20 are arranged in an overlapping manner. Any of the embodiments discussed above, however, may use multiple wythe walls for the mine seal, as shown by the walls in FIGS. 9-12.

Figure 9:
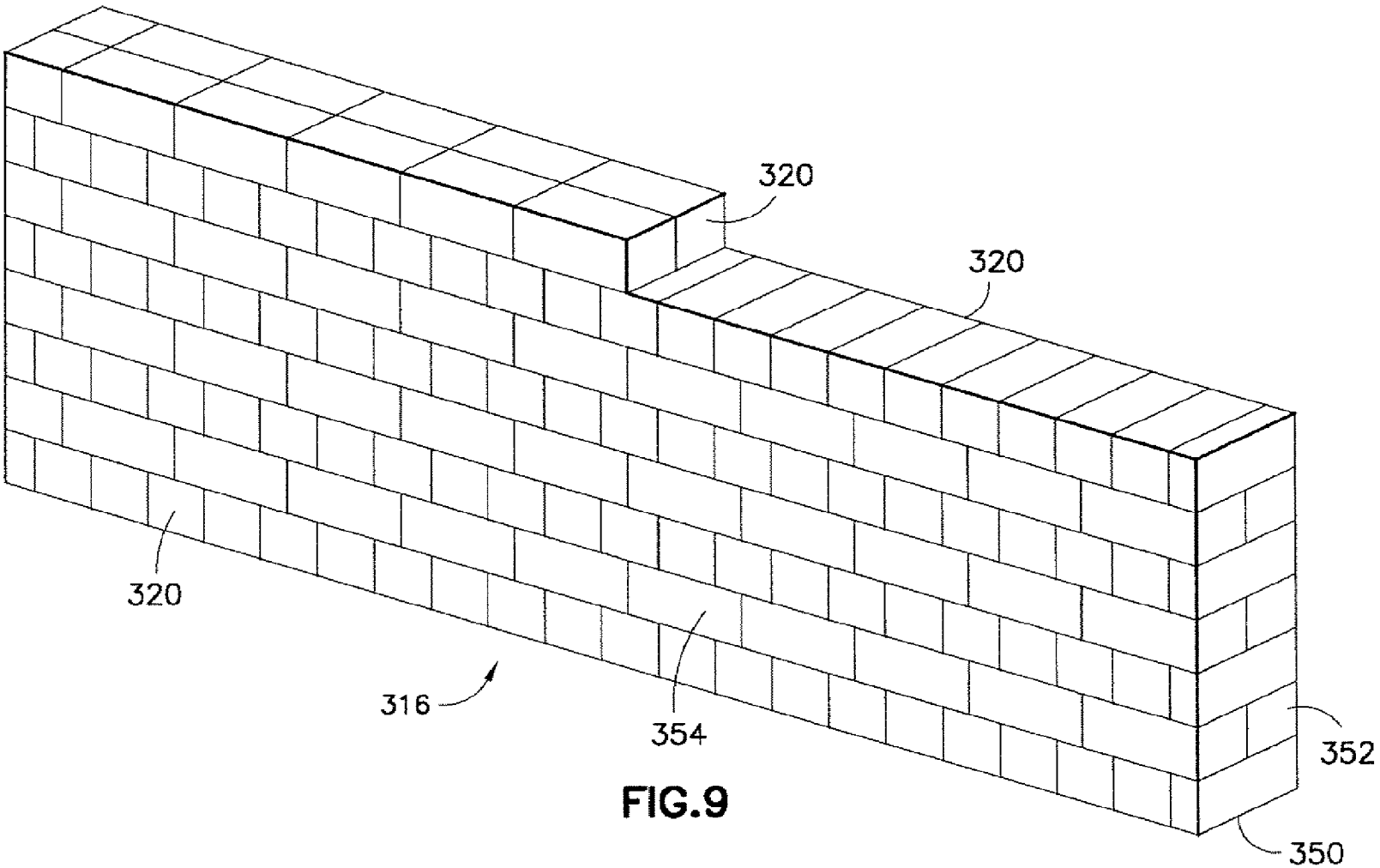
FIG. 9 is a perspective view of a double wythe wall for use in a seal of the present invention.

The walls shown therein may be used in any of the embodiments of FIGS. 1-7. In FIG. 9, a double wythe wall 316 made from blocks 320 is shown having a thickness that corresponds to the width of two of the blocks 320. The wall may be constructed by laying a first course 350 of blocks 320, wherein the blocks 320 are positioned side by side with the ends of the blocks forming a surface 352 of the wall 316. A second course 354 of blocks 320 are then laid across and perpendicular to the blocks 320 in the first course 350, such that the length or long part of the block 320 forms the surface 352 of the wall 316. The first and second courses 350, 354 are repeated until the desired height of the wall 316 is obtained.

Figure 10:
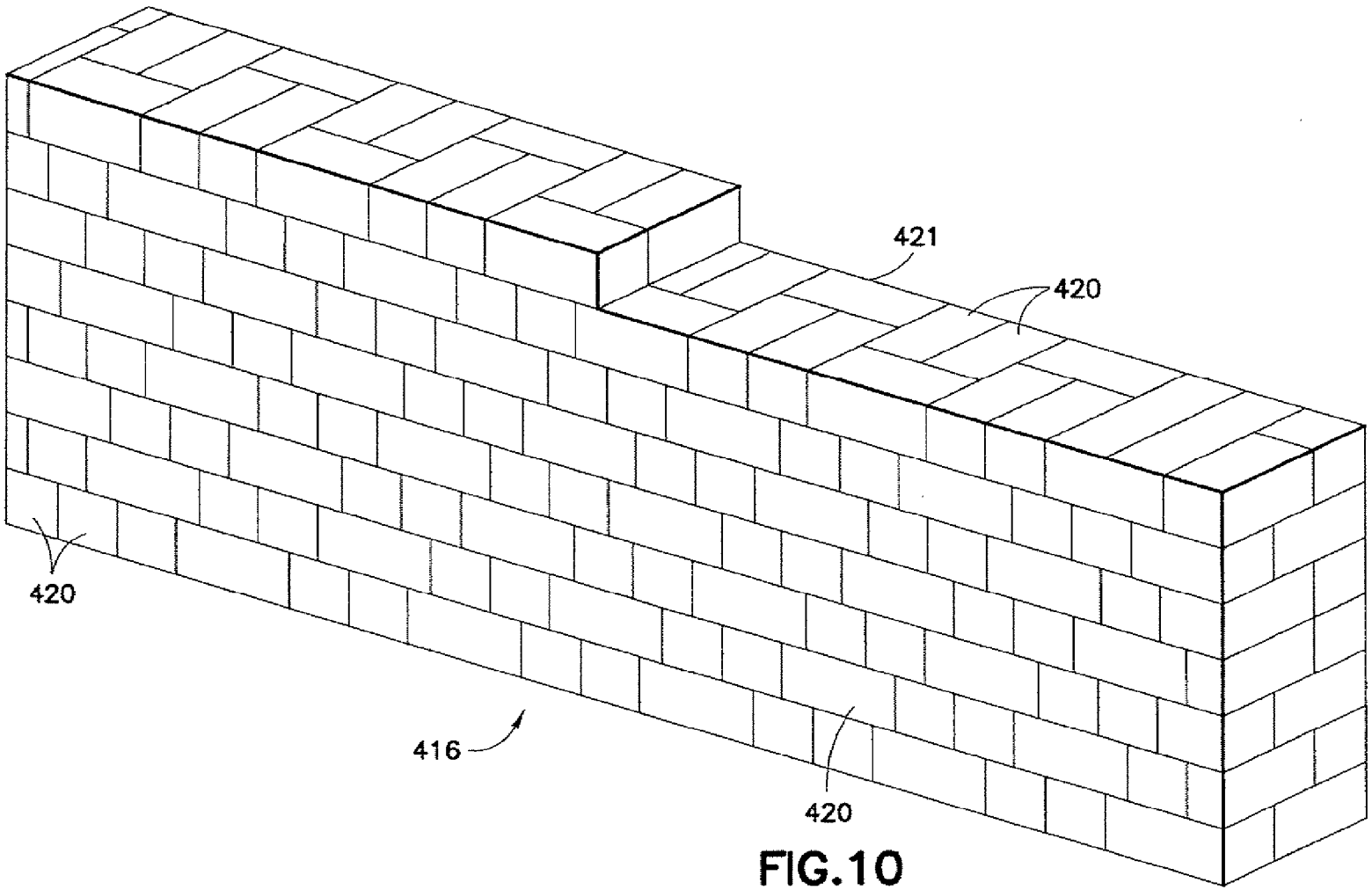
FIG. 10 is a perspective view of a triple wythe wall for use in a seal of the present invention.

In FIG. 10, a triple wythe wall 416, including blocks 420, arranged in a pattern of a stretcher block 421 laid with a longside forming one surface 452 of the wall 416 and two header blocks 422 adjacent and perpendicular to the length of the stretcher block 421 and facing another surface of the wall 416. The sets of blocks 421, 422 are positioned within each course and between courses, such as in the pattern shown, so that interfaces between blocks on adjacent courses are not aligned with each other.

Figure 11:
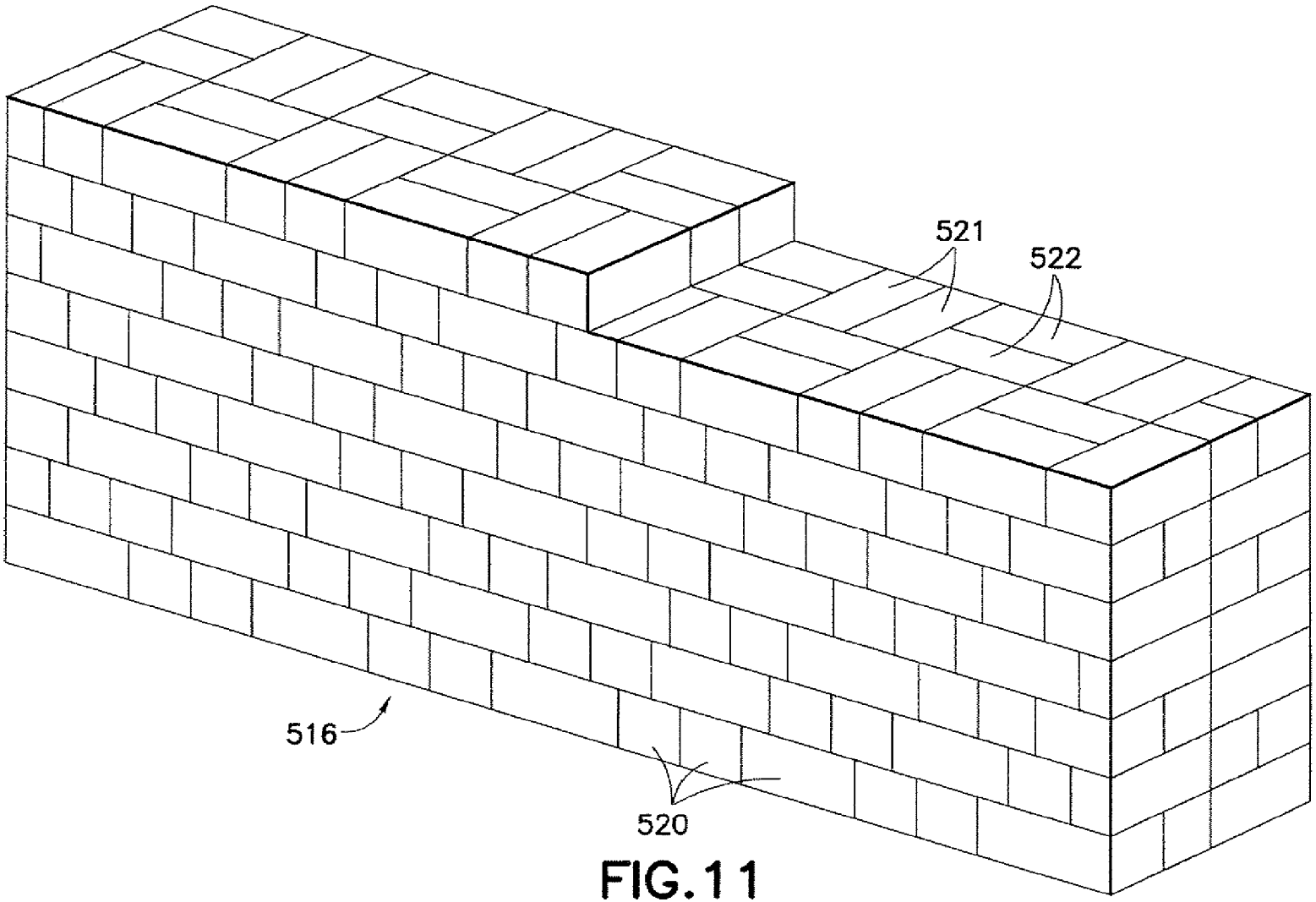
FIG. 11 is a perspective view of a quadruple wythe wall for use in a seal of the present invention.

FIG. 11 shows a quadruple wythe wall 516 made from blocks 520. Each course is shown as including a pair of stretcher blocks 521 laid with a length facing one surface of the wall 516 and a pair of header blocks 522 adjacent and perpendicular to the length of the stretcher blocks 521 and facing a surface of the wall 516.

Figure 12:
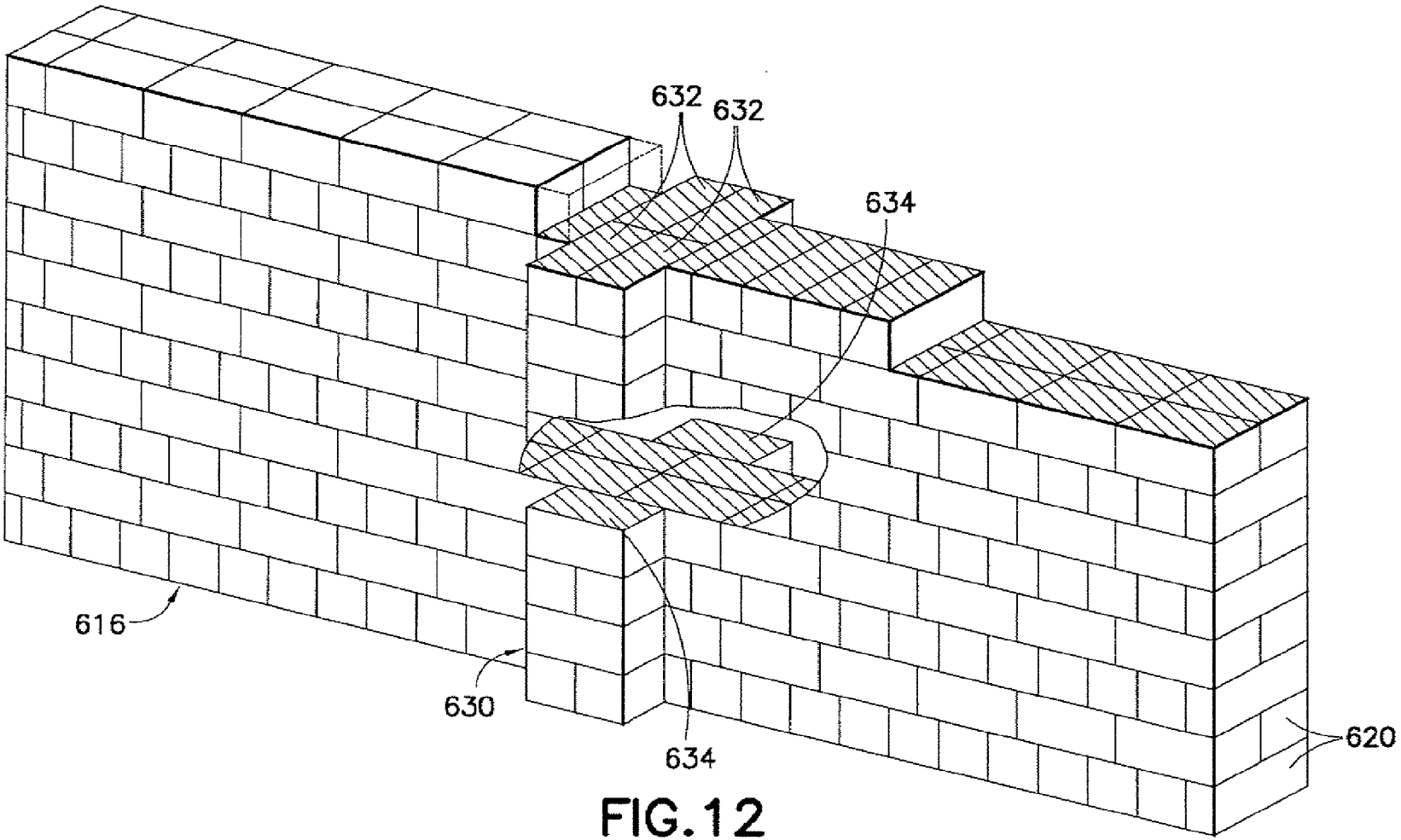
FIG. 12 is a perspective view of another double wall pilaster, shown partially in section, for use in a seal of the present invention.

Any of the walls 14, 16, 316, 416, or 516 according to any of the embodiments described above may be provided in other patterns of blocks and may include a pilaster. By way of example, wall 616 shown in FIG. 12 provided from blocks 620 includes pilaster 630 having blocks 632 in one course which extends from the main portion of the wall 616 and which alternates with another course having blocks 634 arranged parallel to the wall.

Alternatively, walls 14, 16, 316, 416, or 516 may be constructed with blocks having cooperating structures such as tongue and groove features for interlocking the blocks, thereby increasing the strength and integrity of the seal.

The mine seal of the present invention provides a tight seal within the mine entry. The adhesive seals around the entire perimeter of the seal structure, thereby impeding movement of the mine atmosphere from one side of the seal to the other and increasing the integrity of the seal within the mine entry. It has been found that the mine seal of the present invention can withstand mine explosion overpressures of well in excess of 20 psi, such as in excess of 240 psi. The strength of the seal is partially a function of the adhesive material between the blocks, which greatly increases the strength of the block wall bound to the core member over prior seals. The adhesive material also has flexural properties, which allows the seal to better absorb energy and prevent the formation of cracks in the seal over prior seals. Further, the adhesive material does not shrink or degrade over time providing a longer life expectancy for the seal compared to prior seals formed with a cementitious material. Increased strength properties are achievable by coating the surfaces of the front and back walls with layers of the adhesive. In this manner, the strength of the seal may be selected depending on the particular conditions of a mine.

Other underground ventilation control structures may also incorporate the present invention, such as ventilation stoppings and overcasts.

It should be appreciated that the composite wall of the present invention may also be used in the construction industry or the like, such as in foundations, dividing walls, or to provide damage resistance to extraneous explosions (i.e., as a security barrier). Instead of constructing block walls by dry stacking blocks or mortaring blocks, the adhesive used in the present invention creates composite block walls with strength properties heretofore unobtainable.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

The invention claimed is:

1. An underground mine entry structure comprising:

a pair of walls, each said wall comprising a plurality of blocks, the plurality of blocks forming a multiple wythe wall, the multiple wythe wall comprising a pilaster; and a non-cementatious adhesive provided between adjoining surfaces of said blocks within each wall and between said walls, said adhesive having greater strength properties than said blocks.

2. The structure of claim 1, wherein said adhesive comprises a polymeric composition.

3. The structure of claim 2, wherein said polymeric composition comprises polyurethane.

4. The structure of claim 1, wherein said blocks comprise concrete blocks.

5. An underground mine entry barrier comprising:

a wall structure comprising a plurality of blocks, the plurality of blocks forming a multiple wythe wall, the multiple wythe wall comprising a pilaster; and a non-cementatious adhesive provided between adjoining surfaces of said blocks, said adhesive having greater strength properties than said blocks.

6. The barrier of claim 5, wherein said adhesive comprises a polymeric composition.

7. The barrier of claim 6, wherein said polymeric composition comprises polyurethane.

8. The barrier of claim 7, wherein said blocks comprise concrete blocks.

9. An explosion-resistant mine seal comprising:

a front wall structure and a rear wall structure, each said wall structure comprising a plurality of blocks and a non-cementatious adhesive provided between adjoining surfaces of said blocks, wherein said adhesive has greater strength properties than said blocks; and a core member provided between said wall structures and adhering to said wall structures, wherein at least one of said wall structures comprises a multiple wythe wall.

10. The mine seal of claim 9, wherein said wythe wall comprises a pilaster.

11. The mine seal of claim 9, wherein said adhesive comprises a polymeric composition.

12. The mine seal of claim 11, wherein said polymeric composition comprises polyurethane.

13. The mine seal of claim 9, wherein said blocks comprise concrete blocks.

14. The mine seal of claim 9, wherein said core member comprises a foamed polymeric material and aggregate material.

15. The mine seal of claim 14, wherein said foamed polymeric material comprises polyurethane.

16. The mine seal of claim 9, wherein said core member comprises a plurality of blocks formed from a foamed polymeric material.

17. The mine seal of claim 16, wherein the adhesive is provided between adjoining surfaces of said block formed from the foamed polymeric material.

* * * * *